US012247362B1

(12) United States Patent
Alfares et al.

(10) Patent No.: US 12,247,362 B1
(45) Date of Patent: Mar. 11, 2025

(54) ROAD POTHOLE FIXER

(71) Applicant: Kuwait University, Safat (KW)

(72) Inventors: Mohammad A. Alfares, Safat (KW); Shaikha O. Alkhalfan, Safat (KW); Safa M. Karam, Safat (KW); Rabab S. Abdullah, Safat (KW); Zainab K. Ali, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 18/918,444

(22) Filed: Oct. 17, 2024

(51) Int. Cl.
*E01C 23/00* (2006.01)
*E01C 7/18* (2006.01)
*E01C 23/07* (2006.01)

(52) U.S. Cl.
CPC ..... *E01C 23/07* (2013.01); *E01C 7/187* (2013.01)

(58) Field of Classification Search
CPC ..... E01C 7/187; E01C 23/07
USPC ..... 404/75, 83–118
See application file for complete search history.

(56) References Cited

U.S. PATENT DOCUMENTS 5,263,790 A * 11/1993 Bickley ..... E01C 23/06 404/108
5,333,969 A * 8/1994 Blaha ..... E01C 19/46 404/91
5,803,661 A * 9/1998 Lemelson ..... E01C 23/07 404/75
6,988,849 B1 * 1/2006 Zimmerman ..... E01C 23/06 404/95
8,167,513 B2 5/2012 Ryan
9,416,499 B2 * 8/2016 Cronin ..... E01C 23/06
10,676,877 B2 6/2020 Dillingham
11,346,064 B2 5/2022 Dillingham
2008/0031688 A1 * 2/2008 Gilchrist ..... E01C 23/06 404/108
2010/0322710 A1 * 12/2010 Ryan ..... E01C 23/06 404/78

(Continued)

FOREIGN PATENT DOCUMENTS

CN 204287812 U 4/2015
GB 2618437 A 11/2023

OTHER PUBLICATIONS

"AI pothole repair robot in development"; Oct. 26, 2020.

(Continued)

*Primary Examiner* — Raymond W Addie
(74) *Attorney, Agent, or Firm* — Nath, Goldberg & Meyer; Joshua B. Goldberg

(57) ABSTRACT

A pothole-repairing apparatus includes a frame, first and second continuous track assemblies connected to opposite sides of the frame, a brush assembly connected to the frame, an asphalt pouring assembly disposed on the frame, at least one ultrasonic sensor disposed on the frame, a grader blade connected to the frame, a power source disposed on the frame, a controlling circuit disposed on the frame, a transceiver disposed on the frame, and a plurality of motors for controlling the operations of the first and second continuous track assemblies, the brush assembly and asphalt pouring assembly. The brush assembly can be used to clean a pothole free of debris. The asphalt pouring assembly can be used to fill the pothole with an asphalt mix. The asphalt mix can be compacted in the pothole by driving over the asphalt mix with the first and second continuous track assemblies.

20 Claims, 7 Drawing Sheets

(56) References Cited

U.S. PATENT DOCUMENTS

| | | | | |
|---|---|---|---|---|
| 2017/0144669 | A1* | 5/2017 | Spata | E01C 23/01 |
| 2020/0277741 | A1* | 9/2020 | Flitsch | E01C 23/098 |

OTHER PUBLICATIONS

"Pothole Patching Robot for Road Maintenance Automation"; Sep. 21, 2020.
"Pothole Detection and Levelling Robot"; YouTube video posted on Jan. 19, 2022.

* cited by examiner

ROAD POTHOLE FIXER

TECHNICAL FIELD

The present disclosure relates to an apparatus configured to repair roads, and more particularly, to an apparatus configured to repair potholes in road by filling and compacting the potholes with an asphalt material.

DISCUSSION OF THE RELATED ART

Potholes in roads can make a driving experience not only uncomfortable, but also dangerous, depending on the size and depth of the pothole. Road repair crews frequently sustain injuries on the job due to negligent motorists or other reasons beyond the crews' control while filling potholes with asphalt. In addition, pothole repairing jobs often have a high cost due to the large number of pieces of equipment that road repair crews need for completing the job.

SUMMARY

The present disclosure relates to a remote-controlled pothole repairing apparatus. The apparatus of the present disclosure is designed to promote the safety of road repair personnel by enabling road repair workers to stand in a safe location (at a distance from the pothole in the road) while remotely controlling the apparatus of the present disclosure to fill potholes in the surface of the road (or potholes in any other paved structure). A purpose-built remote control or a smart device (e.g., a smartphone, a tablet, a personal computer (PC), etc.,) can be used to remotely control the apparatus of the present disclosure, whether wirelessly or by wire.

The apparatus of the present disclosure is configured to clean a pothole free of debris by using a rotatable brush that can be lowered into the pothole. After the cleaning operation, the apparatus of the present disclosure can be used to pour a sufficient amount of an asphalt mix (e.g., cold mix asphalt) in the cleaned pothole. The asphalt mix can be contained in a hopper of the apparatus.

The apparatus can then be used to spread the asphalt mix around the pothole by using a grader blade. Subsequent to the spreading operation, the asphalt mix can be compacted by driving the apparatus of the present disclosure over the asphalt mix. For example, the apparatus of the present disclosure can be driven back and forth over the spread asphalt such that the weight of the apparatus can compact the asphalt in the pothole.

This configuration does away with the need to use several different machines for performing the cleaning, filling and compacting tasks, thereby reducing the cost associated with filling potholes while increasing the safety of road repair crews.

BRIEF DESCRIPTION OF THE DRAWINGS

The above and other features of the present disclosure will become more apparent by describing in detail exemplary embodiments thereof in conjunction with the accompanying drawings, in which.

DETAILED DESCRIPTION OF THE EMBODIMENTS

Figure 2:
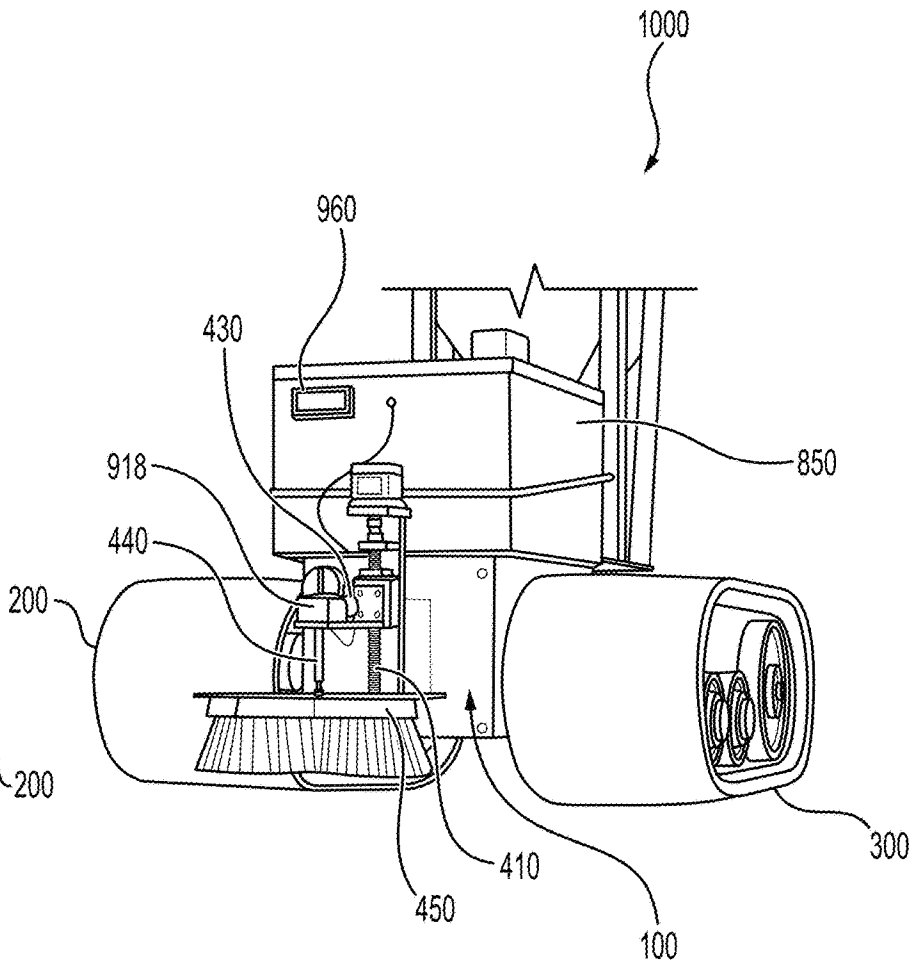
FIG. 2 is a perspective view illustrating the apparatus of FIG. 1.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Figure 3A:
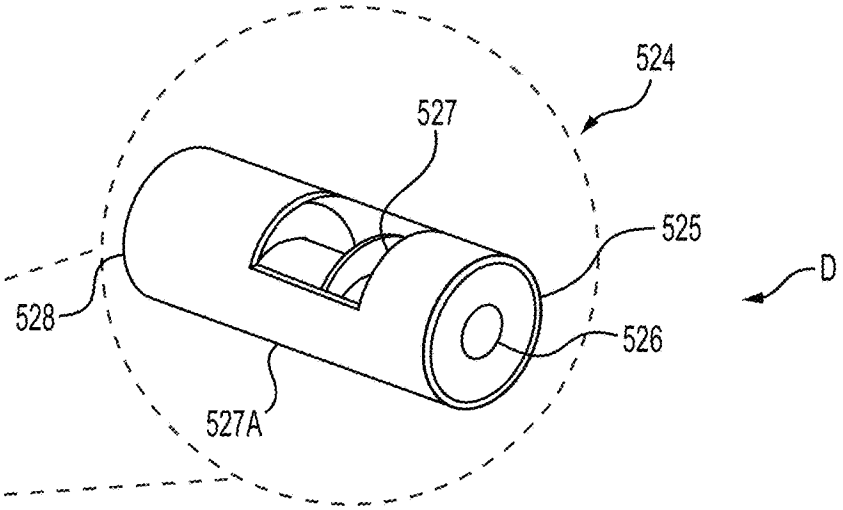
FIG. 3A is a magnified view of a region "D" of FIG. 3.
Figure 3:
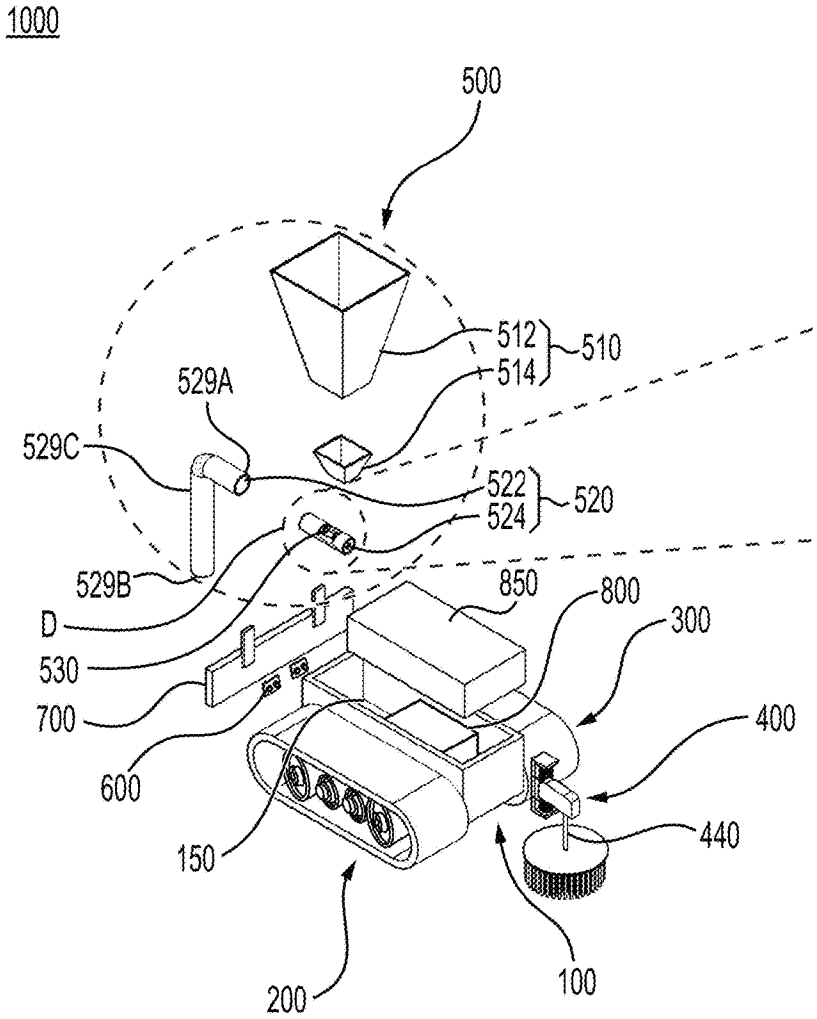
FIG. 3 is an exploded perspective view illustrating the apparatus of FIG. 1.

With reference to FIGS. 1-9, and particularly, FIG. 3, an apparatus 1000 of the present disclosure, configured to repair potholes, may include a frame 100, first and second continuous track assemblies 200, 300, a brush assembly 400, an asphalt pouring assembly 500, at least one ultrasonic sensor 600, a grader blade 700, a power source 800, a controlling circuit 900 (see FIG. 9), a plurality of motors 910, a transceiver 950 and a display panel 960.

Figure 9:
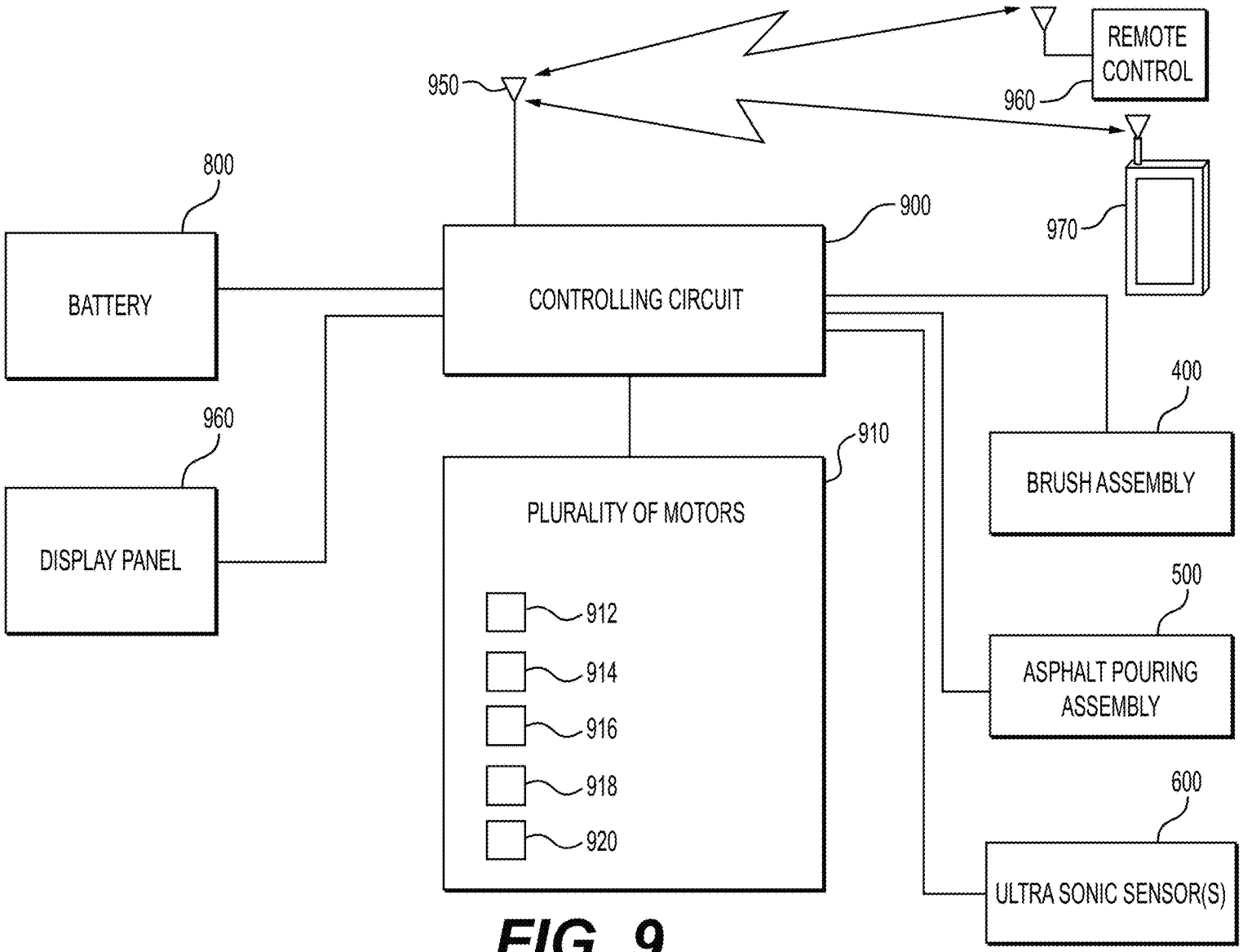
FIG. 9 is a diagram illustrating a diagram of the electrical components of the apparatus of FIG. 1.

As illustrated in FIG. 9, the plurality of motors 910 may include first to fifth motors 912, 914, 916, 918, 920 electrically connected to the controlling circuit 900. Each one of the first to fifth motors 912-920 can be, for example, a direct current (DC) motor, a stepper motor, etc.

Referring to FIG. 9, the display panel 960, the battery 800, the transceiver 950, the brush assembly 400, the asphalt pouring assembly 500 and the at least one ultrasonic sensor 600 may be electrically connected to the controlling circuit 900. The first to fifth motors 912, 914, 916, 918, 920 are also electrically connected to the controlling circuit 900.

The controlling circuit 900 includes a processor configured to execute instructions for operating the apparatus 1000 as described in this specification.

Referring to FIG. 9, the transceiver 950 may be wirelessly connected to a remote control 960 and/or a smart device 970. The wireless connection may be achieved by using, for example, a short-range wireless connection standard (e.g., Bluetooth®), Wi-Fi, a radio frequency band, a cellular frequency band, etc. The remote control 960 can be, for example, a purpose-built handheld device configured to control the operations of the apparatus 1000. The smart device 970 can be, for example, a smartphone, a tablet, a personal computer (PC), etc., having an application software configured to control the operations of the apparatus 1000.

While the remote control 960 and the smart device 970 are illustrated as being wirelessly connected to the transceiver 950, the present disclosure is not limited to this configuration. For example, the remote control 960 and/or the smart device 970 can be communicatively coupled to the controlling circuit 900 by wire.

Figure 1:
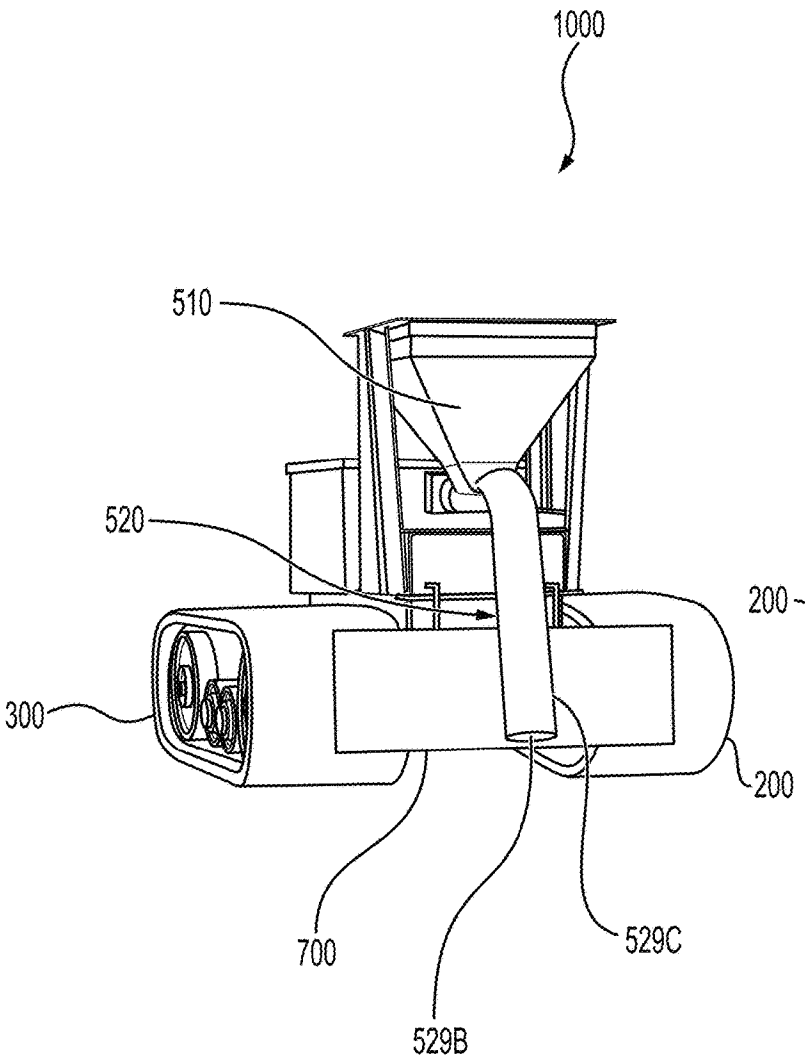
FIG. 1 is a perspective view illustrating an apparatus configured to repair potholes in accordance with an exemplary embodiment of the present disclosure.
Figure 4:
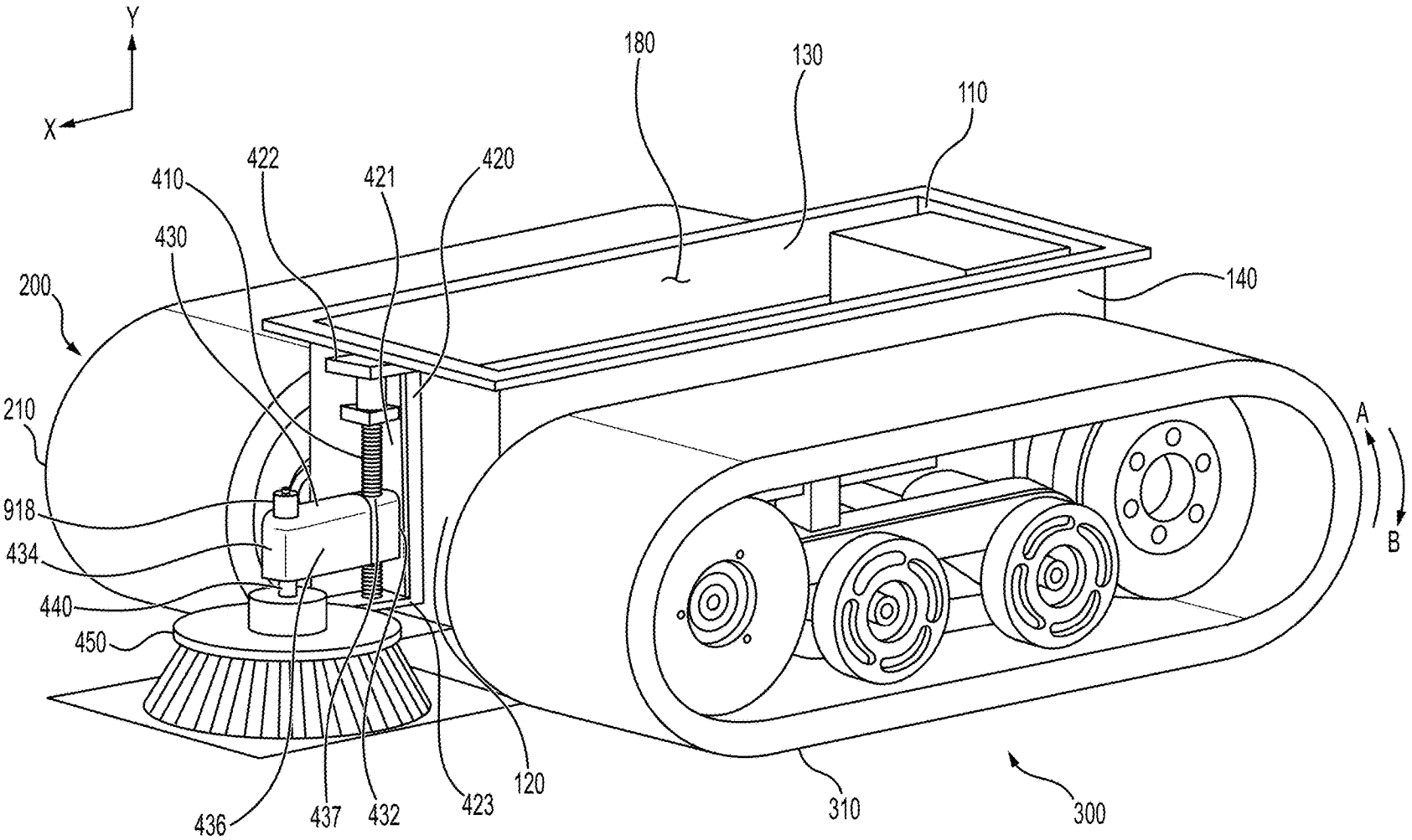
FIG. 4 is a perspective view illustrating a portion of the apparatus of FIG. 1.

The frame 100 may include a plurality of sidewalls. Referring to FIG. 4, the plurality of sidewalls of the frame 100 include a first sidewall 110, a second sidewall 120, a third sidewall 130, a fourth sidewall 140, and a fifth sidewall 150 (see FIG. 1, illustrating the fifth sidewall 150 as being disposed at a bottom the frame 100, connecting the first to fourth sidewalls 110-140 to one another. The first to fifth sidewalls 110-150 define an exterior of the frame 100 and an interior space 180 (see FIG. 4) of the frame 100. The first and second sidewalls 110 and 120 may be disposed opposite to one another, and may respectively define a front and a back of the apparatus 1000 (or vice-versa, depending on one's point of view). The third and fourth sidewalls 130 and 140 may be disposed opposite to one another, may extend between the first and second sidewalls 110, 120, and may connect the first and second sidewalls 110, 120 to one another.

The plurality of sidewalls of the frame 100 may be made of a metal. The metal may be, for example, steel (e.g., carbon steel, stainless steel, cast iron, etc.,), aluminum, zinc, copper, etc., or an alloy thereof. Alternatively, or in addition, the frame may be made of a polymeric material and/or wood. Examples of suitable polymeric material include, for example, polyvinyl chloride (PVC), polycarbonate, nylon, high density polyethylene, etc., or blends thereof.

The power source 800 may be disposed, for example, in the interior space 180. The power source 800 may be, for example, a rechargeable battery. The power source 800 may be utilized to electrically power the apparatus 1000. Alternatively, or in addition to the internal power source 800, the apparatus 1000 may be powered by wire. The wire may electrically connect the apparatus 1000 to an external power source (e.g., the power grid of a building, a generator, etc.). In a non-limiting embodiment, the power source 800 may include three 48V rechargeable batteries. The rechargeable batteries may be, in a non-limiting embodiment, lithium-ion batteries.

Figure 5:
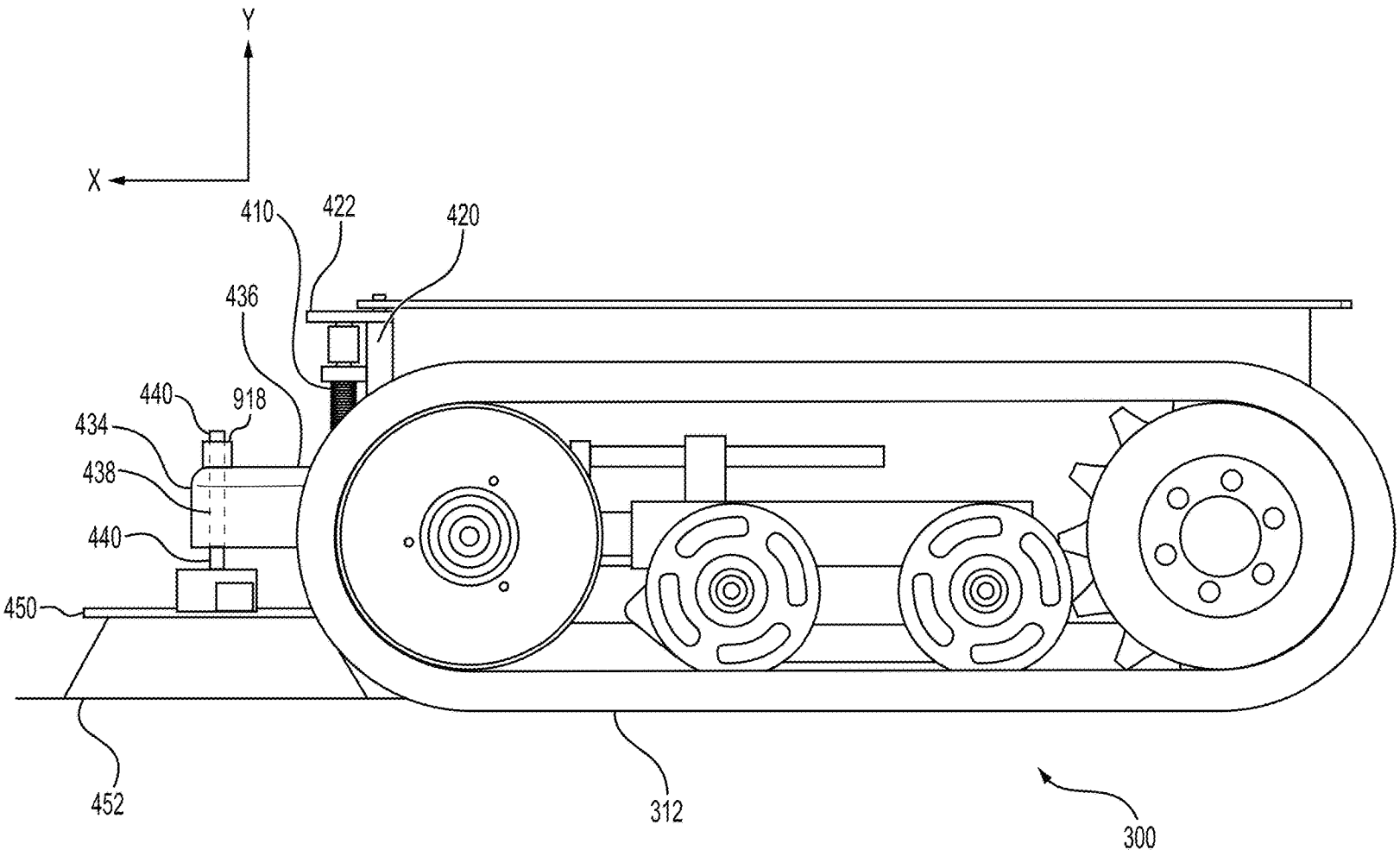
FIG. 5 is a side view illustrating the portion of the apparatus of FIG. 4.

As illustrated in FIGS. 3-5, the first continuous track 200 may be spaced apart from the second continuous track 300. The first continuous track 200 may be connected to the third sidewall 130. The second continuous track 300 may be connected to the fourth sidewall 140. It is understood that this configuration is non-limiting. For example, the first and second continuous tracks 200, 300 can be connected to the fifth sidewall 1150.

Referring to FIGS. 3-5 and 9, the second motor 914 may be connected to the second continuous track 300. The second motor 914 may be configured selectively to rotate (or turn) a continuous belt (or track) of the second continuous track 300 in a first direction A and in a second direction B, opposite to the first direction A.

Referring to FIGS. 3-5 and 9, the first motor 912 may be connected to the first continuous track 200. Referring to FIG. 4, the first motor 912 may be configured to selectively rotate (or turn) a belt (or track) of the first continuous track 200 in opposite directions, similarly to the operation of the second motor 914.

The first and second motors 912 and 914 can be separately controlled via the controlling circuit 900 to drive the apparatus 1000 forward and backwards, and to turn left and right.

The belt or track of each one of the first and second continuous tracks 200, 300 may be, for example, a rubber belt. Alternatively, a steel belt, made of chained links, may be used instead of a rubber belt.

While apparatus 1000 is described as including a pair of motors (e.g., the first and second motors 912, 914) to drive the first and second continuous tracks 200, 300, the present disclosure is not limited to this embodiment. For example, in an alternate embodiment, a single motor can be used to drive both the first and second continuous tracks 200, 300. In the alternate embodiment, a transmission mechanism may be needed to coordinate the transfer of rotation from the single motor to the first and second continuous tracks 200, 300 based on driving directions received from a user (i.e., via the remote control 960 or the smart device 970).

The brush assembly 400 may be connected to at least one of the plurality of sidewalls of the frame 100. For example, with reference to FIG. 3, the brush assembly 400 may be connected to the second sidewall 120.

Referring to FIGS. 4-5, the brush assembly 400 may include a plate 420, a first shaft 410, a supporting arm 430, a second shaft 440 and a brush head 450. The plate 420, the first shaft 410, the supporting arm 430 and second shaft 440 may be made of a metal and/or a polymeric material, as described in this specification. The brush head 450 may include a base plate made and a plurality of bristles extending from the base plate. The base plate and/or the plurality of bristles of the brush head 450 may be made of a metal and/or a polymeric material as described in this specification.

Referring to FIG. 4, the plate 420 may be connected to the second sidewall 120 of the frame 100. The plate 420 may extend in an up-down direction (or vertical alignment), when the apparatus 1000 is aligned substantially horizontally, as illustrated in FIGS. 4-5. Referring to FIG. 4, the plate 420 includes an outer surface 421. For example, the plate 420 may extend parallel to a first imaginary axis Y (see FIG. 4).

Referring to FIG. 4, the first shaft 410 may be connected to the plate 420 via first and second flanges 422, 423. The first and second flanges 422, 423 may extend from the plate 420 or from the second sidewall 120. The first shaft 410 may extend, for example, parallel to the first imaginary axis Y when the apparatus 1000 is oriented substantially horizontally, as illustrated in FIGS. 4 and 5). That is, the first shaft 410 may extend in the up-down alignment.

The supporting arm 430 is connected to the first shaft 410 and is configured to be moved in first and second opposite directions (e.g., up and down) along the first imaginary axis Y while connected to the first shaft 410.

Referring to FIG. 4, the supporting arm 430 includes a first end 432 disposed adjacent to the plate 420, a second end 434 opposite to the first end 432, and a body 436 extending along a second imaginary axis X between the first and second ends 432, 434. The second imaginary axis X may cross the first imaginary axis Y. The second imaginary axis X may be, for example, a horizontal axis.

In the apparatus 1000, the first shaft 410 and supporting arm 430 may have a worm gear connection with one another. The supporting arm 430 may have a first through hole 437 through which the first shaft 410 extends. The first shaft 410 may be a threaded rod (e.g., a worm gear), and the supporting arm 430 may include inside a ring gear threadably and rotatably coupled to the first shaft 410 on the inside of the body 436.

In one approach, the third motor 916 is connected to the first shaft 410, and is configured to rotate the first shaft 410 about the first imaginary axis Y (clockwise and counterclockwise). In this approach, the ring gear inside of the supporting arm 430 is stationary, and the rotation of the first shaft 410 causes the supporting arm 430 to be moved up or down along the first imaginary axis Y, depending on the rotation direction of the third motor 916. An end surface at the first end 432 of the body 436 of the supporting arm 430 is configured to slidably engage with the outer surface 421 of the plate 420. The slidable engagement of the end surface at the first end 432 with the outer surface 421 of the plate 420 prevents the supporting arm 430 from being rotated by the first shaft 410 while enabling the supporting arm 430 to be slid (or moved) up and down about a length of the first shaft 410 due to the rotation of the shaft 410.

In a different approach, the third motor 916 is connected to the ring gear inside of the supporting arm 430. In this approach, the third motor 916 is configured to selectively rotate the ring gear inside of the supporting arm 430 in a clockwise or counterclockwise rotation direction. In this approach the first shaft 410 is stationary, and the rotation of the ring gear inside of the supporting arm 430 causes the supporting arm 430 to be slid (or moved) up and down about a length of the first shaft 410 due to the rotation of the ring gear.

Figure 6:
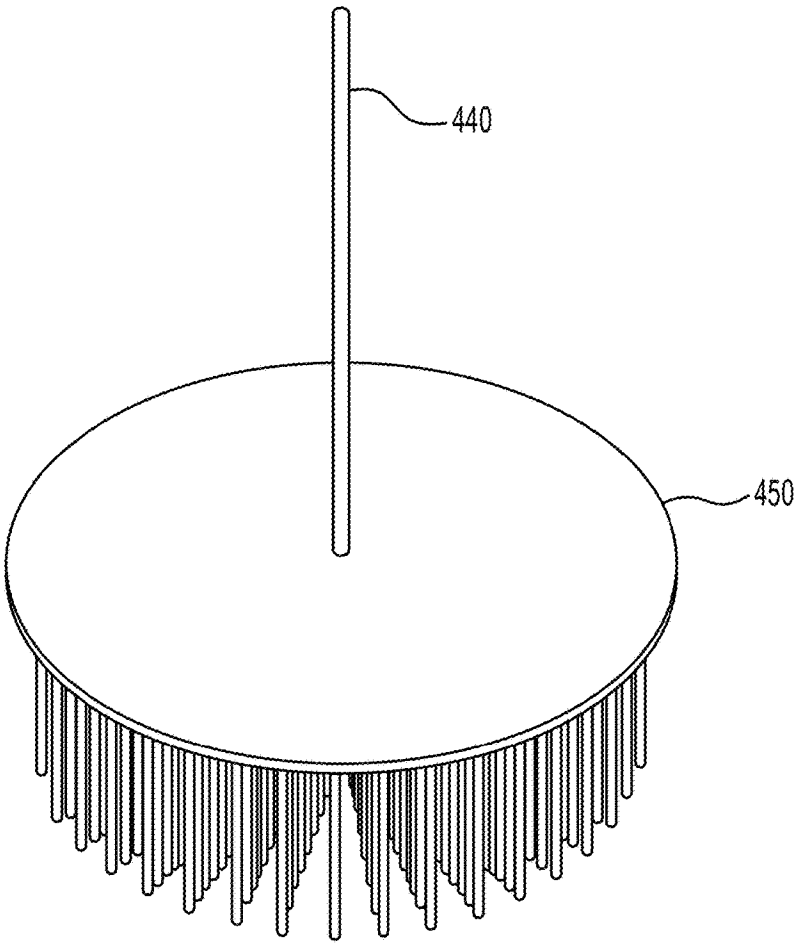
FIG. 6 is a perspective view illustrating a component of a brush assembly of the apparatus of FIG. 1.

As illustrated in FIGS. 4-6, the brush head 450 may be fixedly connected to the second shaft 440, and the second shaft 440 may also extend substantially parallel to the first imaginary axis Y. However, this configuration is not limiting. For example, the first shaft 410 may be aligned at an angle of about 90 degrees relative to the supporting arm 430, or at an angle other than 90 degrees (e.g., at an oblique or obtuse angle) relative to the supporting arm 430. In addition, the second shaft 440 may be aligned at an angle of about 90 degrees relative to the supporting arm 430, or at an angle other than 90 degrees (e.g., at an oblique or obtuse angle) relative to the supporting arm 430. In other words, the second shaft 440 may extend along a third imaginary axis that crosses the second imaginary axis X.

As illustrated in FIG. 5, the body 436 of the supporting arm 430 may include a second through hole 438 through which the second shaft 440 may extend. As illustrated in FIGS. 4-5, the fourth motor 918 may be connected to the second shaft 440. The fourth motor 918 may be configured to rotate the second shaft 440, and therefore, the brush head 450, in a clockwise direction or in a counterclockwise direction about the imaginary first axis Y, depending on a rotation direction of the fourth motor 918.

When the apparatus 1000 is aligned substantially horizontally, as illustrated in FIGS. 3-4, the movement of the supporting arm 430 in the downwardly direction (or second direction) is configured to place a bottom 452 of the brush head 450 (see FIG. 5) below an elevation of a bottom of each one of the first and second continuous track assemblies 200, 300 (see the bottom 312 of the second continuous track assembly 300 in FIG. 5).

The movement of the supporting arm 430 in the upwardly direction (or first direction) is configured to raise the bottom 452 bottom of the brush head 450 at or above the elevation of the bottom of each one of the first and second continuous track assemblies 200, 300. For example, see FIG. 5, illustrating the bottom 452 bottom of the brush head 450 disposed above the bottom 312 of the second continuous track assembly 300.

The brush head 450 can be selectively lowered inside of a pothole (e.g., to reach a bottom of the pothole) by using the third motor 916 as described in this specification). The brush head 450 can then be rotated inside of the pothole via the fourth motor 918 to clean the interior of the pothole. Upon completion of the cleaning operation, the brush head 450 can then be raised upwardly and placed at or above the elevation of the bottom of each one of the first and second continuous track assemblies 200, 300.

This configuration enables the brush assembly 400 to clean potholes, whether the potholes are located on a freeway, local road, driveway, sidewalk, etc.

The brush assembly 400 is described as including the plate 410, but the present disclosure is not limited to this configuration. In an alternate embodiment, the plate 420 can be omitted, and the supporting arm 430 can ride (or be slid) against the second sidewall 120.

Figure 7:
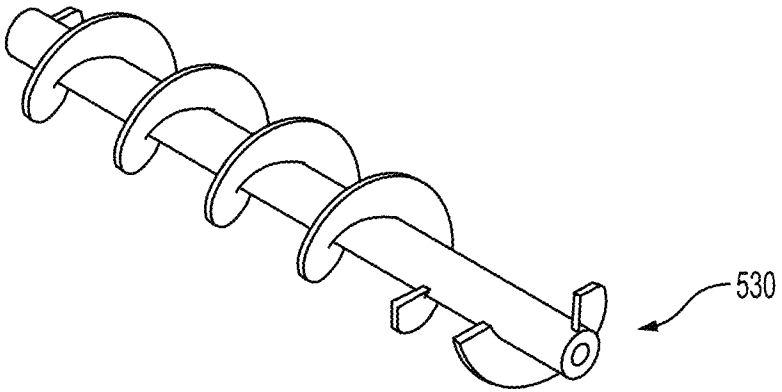
FIG. 7 is a perspective view illustrating a screw conveyor included in an asphalt pouring assembly of the apparatus of FIG. 1.
Figure 8:
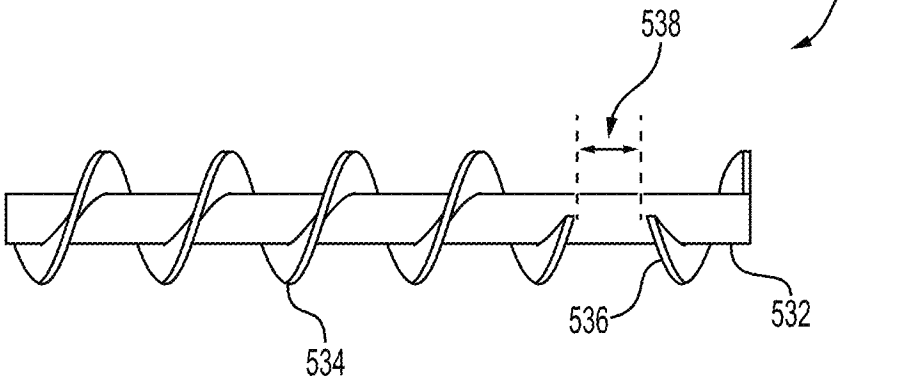
FIG. 8 is a side view illustrating the screw conveyor of FIG. 7.

Referring to FIGS. 3 and 7-8, the asphalt pouring assembly 500 may be connected to at least one of the plurality of the first to fifth sidewalls 110-150 of the frame 100.

Referring to FIGS. 3 and 7-8, the asphalt pouring assembly 500 may include a hopper 510, a conduit 520, and a conveyor mechanism 530. The hopper 510, the conduit 520, and the conveyor mechanism 530 may be made of a metal as described in this specification. Alternatively, or in addition, the hopper 510, the conduit 520, and the conveyor mechanism 530 made of a polymeric material as described in this specification.

The hopper 510 may be formed of a first hopper part 512 (e.g., a top part of the hopper) and a second hopper part 514 (e.g., a bottom part of the hopper). The first and second hopper parts 512, 514 may be connected to one another to form the hopper 510. Alternatively, the hopper 510 can be formed of a single component, or of more than two components connected to one another.

The hopper 510 is configured to be loaded with asphalt for patching (or filling) potholes. The asphalt may be, for example, cold mix asphalt. Cold mix asphalt is an asphalt mixture that can be produced at ambient temperature and used to fill potholes at ambient temperature. That is, cold mix asphalt can be used without a need for heating, unlike hot mix asphalt. This property makes cold mix asphalt versatile and convenient for use in various applications, including filling potholes, especially when hot mix asphalt is not readily available or practical. Cold mix asphalt also requires less effort to install (e.g., to fill potholes) as compared to hot mix asphalt.

The conduit 520 may be formed of a first conduit component 522 and a second conduit component 524 connected to the first conduit component 522 upstream of the first conduit component 522. Alternatively, the conduit 520 may be formed of a single conduit component, or of more than two conduit components joined to one another.

Referring to FIGS. 3-3A, the second conduit component 524 may have a first end 525 with a through opening 526 (such that a shaft for rotating the conveyor mechanism 530 inside of the second conduit component 524, via operation of the fifth motor 920, can extend from an outside of the second conduit component 524 to the inside of the second conduit component 524 to be connected to the conveyor mechanism 530), a second open end 528, a hollow body 527A extending between the first and second ends 525, 528, and a through opening 527 in the body 527A.

Referring to FIGS. 3-3A, the through opening 527 enables fluid communication between an interior of the hopper 510 and an interior of the second conduit component 524 to enable the content of the hopper 510 (e.g., cold mix asphalt) to flow into the second conduit component 524.

The first conduit component 522 may have a first open end 529A in fluid communication with the second open end 528 of the second conduit component 524, a second open end 529B configured to discharge the fluid (e.g., cold mix asphalt) in the first conduit component 522 to an outside of the second conduit component (e.g., into a pothole), and an elongated hollow body 529C extending between the first and second open ends 529A, 529B. As illustrated in FIG. 3, the body 529C may have a bend along its length.

As indicated above, the conveyor mechanism 530 may be disposed inside of the second conduit component 524. The conveyor mechanism 530 is configured to pump a fluid (e.g., cold mix asphalt or any other asphalt mix material in flowable form) that comes into contact with the conveyor mechanism 530 through the opening 527 in the second conduit component 524 through the conduit 520 and outwardly through the second open end 529B of the first conduit component 522.

Referring to FIGS. 7-8, the conveyor mechanism 530 may be a screw type conveyor (or auger conveyor). The screw type conveyor 530 may include a central shaft 532 extending in a length direction of the body 527A of the second conduit component 524, a first flighting (e.g., a helical screw blade) 534 extending along a first portion of the length of the central shaft 532, and a second flighting 536 extending along a second portion of the length of the central shaft 532. As illustrated in FIG. 8, the first and second flightings 534, 536 may be separated from one another by a distance 538 (e.g., a predetermined distance) along a third portion of the length of the central shaft 532. The fifth motor 920 may be connected to the central shaft 532 (e.g., via the through opening 626) to selectively rotate the conveyor mechanism 530.

The opening 527 in the second conduit component 524 may expose the third portion of the length of the central shaft 532, a portion of the first flighting 534 and a portion of the second flighting 536.

Given the outer diameter of the central shaft 532, the outer diameter of the first and second flightings 534, 536 and the distance between two neighboring peaks in the helix of the first flighting 534 (and/or in the second flighting 536), a quantity of asphalt mix pumped through the conduit 520 can be computed in terms of revolutions (more precisely, the angle of rotation) of the conveyor 530. This way, a user of the apparatus 1000 can specify the quantity of the asphalt mix (e.g., cold mix asphalt) to be poured into a pothole via a command transmitted through the remote control 960 and/or the smart device 970.

Therefore, a measured quantity of cold mix asphalt can be selectively poured into a pothole. If the amount of poured cold mix asphalt is insufficient to fill the pothole, a user can simply repeat the process of pouring a second quantity of cold mix asphalt into the pothole. This process can be repeated if necessary until the pothole becomes sufficiently covered in cold mix asphalt. "Sufficiently filled", as used in the specification, includes fully covering a pothole with cold mix asphalt. The term "sufficiently filled" may also include overfilling the pothole to form a pile of cold mix asphalt material over the pothole (the top of the pile protruding upwardly above the road surface adjacent to the pothole).

Referring to FIG. 3, the at least one ultrasonic sensor 600 may be connected to at least one of the plurality of sidewalls 110-150 of the frame 100. For example, the at least one ultrasonic sensor can be connected to the first sidewall 110.

The at least one ultrasonic sensor 600 is configured to emit an ultrasonic sound wave to determine a depth of a pothole located under the frame 100 (or more generally, under the apparatus 1000). In an embodiment, as illustrated in FIG. 3, the apparatus 1000 may include a pair of ultrasonic sensors 600 for increased reliability in measuring the depth of a pothole in the road under the apparatus 1000. The pair of ultrasonic sensors 600 may be connected, for example, to the first sidewall 110 of the frame 100.

Referring to FIG. 3, the grader blade 700 is configured to be used to spread a pile of cold mix asphalt (or other fluid discharged into a pothole from the asphalt pouring assembly 500) that may build up over a pothole as a result of a filling operation (i.e., when using the asphalt pouring assembly 500 to sufficiently fill a pothole). For example, the apparatus 1000 may be driven back and fourth (or in different directions) to cause the grader blade 700 to spread the pile of cold mix asphalt poured over a pothole. The grader blade 700 may be made of a metal or a polymeric material as described in this specification.

The grader blade 700 may be connected to at least one of the plurality of sidewalls 110-150 of the frame 100. As exemplarily illustrated in FIG. 3, the grader blade 700 may be connected to the to the first sidewall 110 of the frame 100. The grader blade 700 may extend across a length of the first sidewall 110 (in a direction between the first and second continuous track assemblies 200, 300.

When the apparatus 1000 is aligned horizontally (See FIGS. 4-5), a bottom surface of the grader blade 700 is located at a higher elevation than an elevation of a bottom surface of the first track assembly 200 and at a higher elevation than an elevation of a bottom surface of the second track assembly 300. This configuration enables the apparatus 1000 to initially leave some cold mix asphalt protruding over the top surface of the road after the asphalt spreading operation. The protrusion of the cold mix asphalt over the top surface of the road enables the cold mix asphalt to be subsequently compacted (by a compacting operation) without causing the elevation of the cold mix asphalt in the pothole to sink under the top surface of the road during the compacting operation. This configuration may prolong the life of the pothole repair work performed by using the apparatus 1000. This is because a sunken and/or not well compacted asphalt mix material filling a pothole tends to have a shorter lifespan (in remaining fixed inside of the pothole filled) than an asphalt filling that matches the top elevation of the road or protrudes slightly above it.

The vertical distance by which the bottom surface of the grader blade 700 is disposed over the bottom surfaces of the first and second track assemblies 200, 300 may be set as desired. In addition, the grader blade 700 can be movably connected to the frame 100 such that its elevation, relative to the elevation of the bottom surfaces of the first and second track assemblies 200, 300, can be selectively adjusted.

The display panel 960 may be disposed on the frame 100 (e.g., on any one of the sidewalls of the frame 100). The display panel 960 may be configured to illustrate, for example, a depth of a pothole as measured by using the at least one ultrasonic sensor 600, the charge level of the power source 800, etc.

The apparatus 1000 may also include a housing 850. The housing 850 may be disposed on the frame 100. For example, the housing 850 may be disposed on the first to fourth sidewalls 110-140 of the frame 100. The housing 850 may be waterproof or weatherproof. The controlling circuit 900, the transceiver 950 and one or more of the plurality of motors 910 may be disposed in the housing 850 for protection from the weather elements. Alternatively, the housing 850 can be omitted, and the controlling circuit 900, the transceiver 950 and one or more of the plurality of motors 910 can be housed in the interior space 180 of the frame 100. In yet a different approach, the housing 850 may be inserted in the interior space 180 of the frame 100.

The remote control 960 may be a purpose-built device configured to remotely control operations of the apparatus 1000. For example, the remote control 960 may have a controlling circuit and a transceiver configured to communicate with the transceiver 950 of the apparatus 1000 wirelessly or by wire. The remote control 960 may include a display screen configured to display the depth of a pothole as measured by using the at least one ultrasonic sensor 600 of the apparatus 1000. The display screen of the remote control 960 may also be used to indicate the charge level of the power source 800.

In addition, the remote control 960 may include an array of buttons and/or touch screen features for controlling the driving of the apparatus 1000 by using the first and second motors 912, 914, for controlling the operation of the at least one ultrasonic sensor 600 (i.e., to use the at least one ultrasonic sensor 600 to emit an ultrasonic sound wave into a pothole to determine the depth of the pothole), for controlling the operation of the brush assembly 400 (i.e., to use the third and fourth motors 916, 918 to lower the brush head 450 into a pothole and to rotate the brush head 450 inside of the pothole to clean the pothole, then to retract the brush head 450 from the pothole), and for controlling the operation of the asphalt pouring assembly 500 (i.e., to operate the fifth motor 920 to rotate the conveyor mechanism 530 to fill a pothole with a cold mix asphalt or other fluid).

The smart device 970 may include have a transceiver, a controlling circuit, a touch screen display and/or a plurality of control buttons. The smart device 970 may have an application software (e.g., app) installed therein to control the operations of the apparatus 1000 as described in this specification with reference to the remote control 960.

A method of operating the apparatus 1000 includes filling the hopper 510 (at least partially) with a fluid suitable for patching potholes. In a non-limiting example, the fluid is a flowable asphalt mix. The flowable asphalt mix is, in a non-limiting example, cold mix asphalt. The remote control 960 or the smart device 970 can be communicatively coupled to the apparatus 1000 wirelessly or by wire. Via a command from the remote control 960 or the smart device 970, the apparatus 1000 can be driven to the location of a pothole. Specifically, the driving operation can result with locating the at least one ultrasonic sensor 600 over the pothole.

Via a command from the remote control 960 or the smart device 970, the at least one ultrasonic sensor 600 can be powered to emit an ultrasonic sound wave into the pothole. The time it takes for the echo of the ultrasonic wave to travel back to the at least one ultrasonic sensor 600 can be used to determine the depth of the pothole. The determined pothole depth can be displayed on the display panel 960 and/or can be transmitted to the remote control 960 or the smart device 970 to be displayed to the operator of the remote control 960 or the smart device 970 on a screen of said device(s).

The operator may compare the determined pothole depth with a predetermined threshold value. If the depth of the pothole exceeds a predetermined threshold value, the pothole repair operation may be terminated based on the premise that the repair job of a pothole of certain depth (e.g., a depth that reaches the gatch layer, the sand layer, the bare earth layer under the road surface, etc.,) will be short lived. This is because the filling material (e.g., cold mix asphalt) will likely sink into the ground quickly or be dislodged from the pothole in little time due to not having a strong supporting base underneath.

If the depth of the pothole is under the predetermined threshold value, the pothole repair process may proceed by driving the apparatus 1000 to position the second open end 529B of the first conduit component 522 of the conduit 520 of the asphalt pouring assembly 500 over the pothole (by using the remote control 960 or the smart device 970).

Via a command from the remote control 960 or the smart device 970, an operator can power the fifth motor 920 to turn the conveyor mechanism 530 to pour the fluid (e.g., cold mix asphalt) into the pothole such that the pothole can be sufficiently filled.

After the filling operation, the operator can spread the poured fluid around the pothole by using the grader blade 700. For example, the operator can control the apparatus 1000 (via the remote control 960 or the smart device 970) to move back and forth (or in a plurality of directions) such that the grader blade 700 can spread the pile of poured asphalt mix around the pothole.

After the spreading operation, the operator can compact the spread asphalt mix over the pothole by driving over the spread mix with the first and/or second continuous track assemblies 200, 300. The weight of the apparatus 1000 can be applied to the fluid (e.g., the cold mix asphalt) via the belt of each one of the first and/or second continuous track assemblies 200, 300 to compact the fluid in the pothole. This operation will prolong the life of the pothole repair job. In addition, the usage of the apparatus 1000 to compact the cold mix asphalt reduces the need to bring a separate compacting machine in the field for compacting the asphalt mix, thereby reducing material and labor costs in repairing potholes.

The operator can then drive the apparatus 1000 to the location of a different pothole for repairing the different pothole as described in this specification. Alternatively, the operator may drive the apparatus 1000 back to the location of the operator for servicing the same (e.g., recharging the power supply 800, refilling the asphalt pouring assembly 500 with a road-patching fluid, cleaning the apparatus 1000, etc., as the case may be).

The apparatus 1000 can be used to safely repair potholes in roads an in other locations by enabling the operator to stand in a safe place (from where the pothole is visible or can be monitored by using a camera) and to send to apparatus 1000 to repair the pothole. Therefore, the apparatus 1000 can be used to eliminate or reduce injuries occurring to road repair crews due to various road hazards while patching potholes in a way that ensures a long life of the repair job.

In addition, and depending on the size of potholes that must be filled, the apparatus 1000 can be constructed to be portable. For example, the apparatus 1000 can be constructed to have a size and weight that enables it to be lifted by one or two road repair workers, and to fit in a conventional service vehicle (e.g., in a car's trunk, in the bed of a pickup truck, inside of a van, etc.,) for ease of transportation.

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. An apparatus configured to repair potholes, comprising:

a frame including a plurality of sidewalls, the plurality of sidewalls including a first sidewall and a second sidewall, the first and second sidewalls being opposite to one another;

a first continuous track assembly connected to the first sidewall;

a second continuous track assembly connected to the second sidewall;

at least one motor connected to the first and second continuous track assemblies;

a brush assembly connected to at least one of the plurality of sidewalls of the frame;

at least one motor connected to the brush assembly;

an asphalt pouring assembly connected to at least one of the plurality of sidewalls of the frame;

a fifth motor connected to the asphalt pouring assembly;

at least one ultrasonic sensor connected to at least one of the plurality of sidewalls of the frame, the at least one ultrasonic sensor being configured to emit an ultrasonic sound wave to determine a depth of a pothole located under the apparatus;

a grader blade connected to at least one of the plurality of sidewalls of the frame;

a power source;

a transceiver; and a controller circuit electrically connected to the power source, the at least one motor connected to the first and second continuous track assemblies, the at least one motor connected to the brush assembly, the fifth motor, the at least one ultrasonic sensor and the transceiver, the controller circuit being configured to operate the at least one motor connected to the first and second continuous track assemblies, the at least one motor connected to the brush assembly, the fifth motor, and the at least one ultrasonic sensor based on control signals received via the transceiver, the controller circuit further being configured to determine the depth of the pothole by using the at least one ultrasonic sensor and to transmit the determined depth of the pothole to a remote device communicatively coupled to the controller circuit via the transceiver.

2. The apparatus of claim 1, wherein the at least one ultrasonic sensor includes first and second ultrasonic sensors.

3. The apparatus of claim 1, wherein, when the apparatus is aligned horizontally, a bottom surface of the grader is located at a higher elevation than an elevation of a bottom surface of the first track assembly.

4. The apparatus of claim 1, wherein the brush assembly includes:

a first shaft connected to a third sidewall of the plurality of sidewalls, the third sidewall extending between the first and second sidewalls and connecting the first and second sidewalls to one another, the first shaft extending along a first imaginary axis;

a supporting arm connected to the first shaft and configured to be moved along a length of the first shaft in a first direction, along the first imaginary axis, and in a second direction, opposite to the first direction, along the first imaginary axis, the supporting arm extending along a second imaginary axis, the first and second imaginary axes crossing one another;

a second shaft rotatably connected to the supporting arm, the second shaft extending along a third imaginary axis, the third imaginary axis crossing the second imaginary axis; and a brush head connected to the second shaft, wherein, when the apparatus is aligned horizontally, the movement of the supporting arm in the first direction is configured to place a bottom of the brush head below an elevation of a bottom of the first continuous track assembly, and the movement of the supporting arm in the second direction is configured to place a bottom of the brush at or above the elevation of the bottom of the first continuous track assembly.

5. The apparatus of claim 4, wherein the first shaft is threaded along its length, and wherein the supporting arm includes a ring gear threadably connected to the first shaft.

6. The apparatus of claim 5, wherein the first shaft is rotatably connected to the third sidewall, wherein the ring gear is fixed to the supporting arm, and wherein the at least one motor connected to the brush assembly includes a third motor connected to the first shaft and a fourth motor connected to the second shaft.

7. The apparatus of claim 5, wherein the first shaft is fixedly connected to the third sidewall, wherein the ring gear is rotatably coupled to the supporting arm, and wherein the at least one motor connected to the brush assembly includes a third motor connected to the ring gear and a fourth motor connected to the second shaft.

8. The apparatus of claim 1, wherein the asphalt pouring assembly includes:

a hopper, a conduit connected to the hopper, the conduit having a first end, a second open end and a hollow body extending between the first and second ends thereof, the hollow body of the conduit including an opening at a bottom of the hopper, the opening fluidly connecting an interior of the hopper with an interior of the hollow body of the conduit, enabling an asphalt mix or other fluid substance contained in the interior of the hopper to flow in the hollow body of the conduit; and a conveyor mechanism disposed in the hollow body of the conduit, the conveyor mechanism configured to be in fluid communication with the asphalt mix or other fluid in the body of the conduit, and to pump the asphalt mix or other fluid toward the second open end of the hollow body of the conduit such that the asphalt mix or other fluid can be discharged outwardly from the conduit via the second open end thereof.

9. The apparatus of claim 8, wherein the conveyor mechanism is a screw conveyor.

10. The apparatus of claim 9, wherein the screw conveyor includes a central shaft and a first flighting extending along a first portion of a length of the central shaft.

11. The apparatus of claim 10, wherein the central shaft extends in a length direction of the hollow body of the conduit.

12. The apparatus of claim 10, wherein the fifth motor is connected to the central shaft.

13. The apparatus of claim 10, wherein the screw conveyor further includes a second flighting extending along a second portion of the length of central shaft, different from the first portion of the length thereof.

14. The apparatus of claim 13, wherein the first and second flightings are separated from one another along the length of the central shaft.

15. A method of operating an apparatus configured to repair potholes, the method comprising:

filling a hopper of the apparatus configured to repair potholes with a flowable asphalt mix; and using a remote control or a smart device communicatively coupled to said apparatus to:

drive said apparatus to a location of a pothole;

emit an ultrasonic wave into the pothole by using an ultrasonic sensor of said apparatus;

determine a depth of the pothole by considering an amount of time that an echo of the ultrasonic wave takes to travel back to the ultrasonic sensor;

pouring a quantity of the flowable asphalt mix into the pothole by using the apparatus;

spreading the poured quantity of the flowable asphalt with a grader blade of the apparatus; and compacting the spread flowable asphalt by driving the apparatus over the spread flowable asphalt.

16. The method of claim 15, further comprising a step of comparing the determined depth of the pothole with a predefined threshold value, and determining that the depth of the pothole is less than the predefined threshold value.

17. The method of claim 15, wherein the pouring step includes using a motor of the apparatus to rotate a screw conveyor of the apparatus, the screw conveyor being in fluid communication with the flowable asphalt mix in the hopper.

18. The method of claim 15, wherein the flowable asphalt mix is cold mix asphalt.

19. The method of claim 15, wherein the using of the remote control or the smart device communicatively coupled to said apparatus further comprises a step of cleaning the pothole by using a brush assembly of the apparatus prior to the pouring step.

20. The method of claim 19, wherein the cleaning step includes using the apparatus to lower a brush head of the brush assembly into the pothole and rotating the brush head inside of the pothole.

* * * * *